United States Patent [19]

Wojciechowski

[11] 4,214,931

[45] Jul. 29, 1980

[54] METHOD AND APPARATUS FOR FORMING AND PROCESSING ROVING

[75] Inventor: Stanley P. Wojciechowski, Narragansett, R.I.

[73] Assignee: Owens-Corning Fiberglas Corporation, Toledo, Ohio

[21] Appl. No.: 918,625

[22] Filed: Jun. 23, 1978

Related U.S. Application Data

[63] Continuation of Ser. No. 740,581, Nov. 10, 1976, abandoned.

[51] Int. Cl.[2] ..... D02G 3/40

[52] U.S. Cl. ..... 156/169; 34/154; 156/180; 156/272; 156/381; 156/425; 156/411; 156/499; 242/18 G

[58] Field of Search ..... 156/180, 169, 173, 175, 156/441, 433, 272, 499, 380, 381, 425, 166, 168; 242/18 G, 18 R; 34/153, 154, 152; 219/10.61; 65/11 W; 57/297, 303

[56] References Cited

U.S. PATENT DOCUMENTS

| | | | |
|---|---|---|---|
| 2,519,728 | 8/1950 | Alexander | 34/153 |
| 3,088,297 | 5/1963 | Kapany et al. | 65/11 W |
| 3,717,311 | 2/1973 | Smith | 242/18 G |
| 3,718,448 | 2/1973 | Drummond et al. | 65/11 W |
| 3,851,453 | 12/1974 | Robertson | 65/11 W |
| 3,999,715 | 12/1976 | Schippers . | |

*Primary Examiner*—Michael W. Ball

*Attorney, Agent, or Firm*—Ronald C. Hudgens; Philip R. Cloutier; Kenneth H. Wetmore

[57] ABSTRACT

The disclosure embraces a process and apparatus for producing a roving package of strands of glass fibers or filaments bearing a coating material including converging the strands into a linear bundle or roving with the strands oriented into a ribbonized formation and winding the bundle or roving into a package in an enclosed chamber and heating the package in the chamber sufficiently during its formation to cause the coating material on the strands to cohere the glass strands of the bundle or roving together so that upon cooling of the package the ribbonized roving can be readily unwound or removed.

15 Claims, 4 Drawing Figures

METHOD AND APPARATUS FOR FORMING AND PROCESSING ROVING

This is a continuation of application Ser. No. 740,581, filed Nov. 10, 1976, now abandoned.

It has heretofore been a general practice to converge coated strands of glass filaments into a roving and wind the roving into packages wherein the packages weigh from twenty pounds to fifty pounds. After the packages are wound, they are placed in an oven and heated for a period of thirty to ninety minutes to soften the coating so that when cooled the strands of roving will cohere to each other.

After the package cools the roving is of ribbonized character so that when it is pulled from the package it is more like a ribbon than a group of loose strands. The ribbonizing characteristic of the roving facilitates further processing as the roving may be more completely run out or withdrawn from the package before collapse of the outermost regions of the package. In further processing, the comparatively small packages of roving necessitate frequent replacement with full packages in order to facilitate a continuing process.

Recent developments have been made in winding large roving packages particularly useful in high volume roving-consuming processes. Large roving packages are being produced such as packages weighing two hundred to five hundred pounds or more. With the production of large packages of roving it is found that a five hundred pound roving package placed in a conventional post treatment oven at a temperature of 230° F. to 270° F. required many hours or days to soften the coating material throughout the package so that a good ribbon may be formed.

In such developments it was found expedient to direct radiant heat onto a lengthwise surface zone of the package whereby the surface of the package could be elevated in temperature above the softening point of the material to thereby form a ribbon-like roving. As the radiant heat is directed from a heater toward a lengthwise limited surface zone of the package, it is found that a large amount of radiant heat applied to the limited surface zone is required to soften the coating material on the strand as the package during winding is exposed to the atmosphere. Through this process a large amount of heat is lost.

An object of the present invention resides in a method of and apparatus for treating a bundle of coated glass strands as the bundle is being continuously wound into a package in a substantially enclosed environment or chamber by heating the package in the environment or chamber sufficiently during formation of the package to cause the coating to cohere the strands of the bundle so that upon cooling of the package a united bundle or roving can be removed therefrom.

Another object of the invention resides in a method of forming a package of roving of glass strands bearing a coating material by winding the roving of strands into a package in an isolated environment, enclosure or oven and applying radiant heat onto the package within the environment, enclosure or oven and the radiant heat re-reflected from interior surfaces whereby to maintain the isolated environment at a temperature effecting treatment of the coating material on the strands to cohere the strands into a roving of ribbonized character so that after the completion of a package and the package cooled, the ribbonized roving can be readily removed or unwound from the package.

Another object of the invention resides in a method of and apparatus for winding a bundle of glass strands into a package within an insulated enclosure or chamber by supplying radiant heat in the enclosure or chamber and re-reflecting heat from interior surfaces of the enclosure or chamber to effect treatment of the coating on the glass strands wherein a greatly reduced amount of heat is required to effect the treatment of the coating material in forming a package of roving of ribbonized character.

Another object of the invention embraces a method of advancing a bundle of strands bearing coating material into engagement with an instrumentality for orienting the bundle of strands into a ribbonized formation prior to winding the bundle into a package.

Another object of the invention resides in a method of and apparatus for winding a bundle of glass strands into a package within an enclosure or chamber involving increasing the volume or size of the enclosure or chamber to accommodate the enlarging package.

Further objects and advantages are within the scope of this invention such as relate to the arrangement, operation and function of the related elements of the structure, to various details of construction and to combinations of parts, elements per se, and to economies of manufacture and numerous other features as will be apparent from a consideration of the specification and drawing of a form of the invention, which may be preferred, in which.

Figure 1:
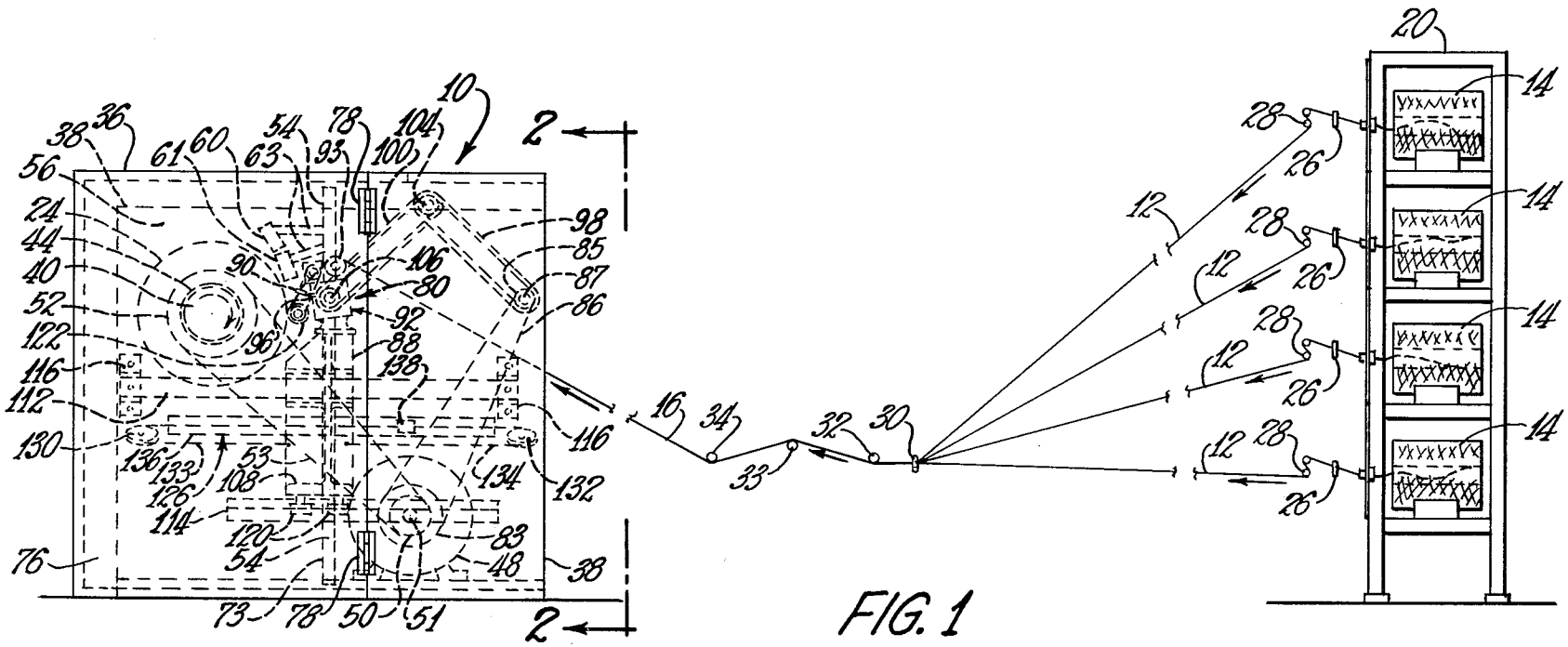
FIG. 1 is a semischematic side elevational view of one form of winding apparatus and strand supply means for carrying out the method of the invention.

Referring to the drawings in detail and initially to FIG. 1, there is illustrated a form of winding apparatus 10 embodying the invention for combining strands 12 from strand packages 14 into a single linear bundle or roving 16 and winding the same into a package in an enclosed or isolated heated environment, chamber or oven. The packages 14 contain strands 12 of fibers or filaments of glass, the filaments of the strands 12 having been previously coated with a coating material before the strands are wound into the packages 14. The coating material on the strands in the packages 14 is in a substantially dry or nontacky condition.

The strands of the packages 14 are composed of groups of fibers or filaments attenuated from streams of glass as is conventional in this art. The packages 14 are mounted upon a creel frame or support 20. The linear bundle or roving 16 of strands is wound into a package 24 in an enclosed environment, chamber or oven of the winding apparatus 10 as hereinafter described.

Each of the glass strands 12 is drawn through a guide member 26 and an adjustable tensioning device 28 to establish tension in each of the strands. The strands 12 are converged by a guide means or eye 30 into the linear bundle or roving 16. The linear bundle or group of strands 12 is engaged with or threaded over spreader bars 32, 33 and 34. The spreader bars tend to orient or arrange the strands 12 of the group in a generally sideby-side relation forming a band or ribbon-like bundle or roving 16.

The glass filaments of each strand are held together by sizing or other coating material applied to them during the filament-forming operation. The sizing or coating material is subjected to heat treatment as the roving or bundle of strands 16 is wound into a package by the winding apparatus. The sizing is heat-treatable and can be a thermoplastic material or a thermosettable plastic material that has not been fully cured. For example, the heat-treatable or heat-softenable sizing or coating material may be a resin such as ethylene vinyl acetate, polyvinyl acetate or the like. A thermosettable resin may be of the phenolformaldehyde type.

The winding apparatus 10 comprises a housing structure 36 which provides an enclosure or chamber in which the roving or bundle of strands is wound into a package and wherein radiant heat is provided for treating or softening the coating material on the roving or bundle of strands as the package is being formed. The winding apparatus is of the general character disclosed in the U.S. Pat. No. to Smith 3,717,311. The housing construction includes a portion 38 which provides a frame or support for components of the winding apparatus.

Journally mounted within a member or support 39 forming a component of the housing portion 38 is a package winding mandrel or collet 40 connected with a drive shaft 41 which rotates the collet 40. Speed reducing mechanism between the drive shaft 41 and the collet 40 is contained within the member 39. The winding mandrel or collet 40 is adapted to telescopingly receive a tubular collector or forming tube 44 upon which the roving package 24 is formed.

A variable speed electrically energizable motor 48 disposed in the portion 38 of the housing construction is arranged to rotate the drive shaft 41 and the collet or package winding mandrel 40 and the traversing mechanism for traversing the roving or strand bundle lengthwise of the package. A sheave 50 on the motor shaft 51 drives a sheave 52 on the shaft 41 by a belt 53 connecting the sheaves. The roving traversing mechanism will be hereinafter described.

Disposed within the housing 36 is a movable member, wall or partition 54 which forms with other interior surfaces or walls of the housing an enclosed environment, enclosure, chamber or oven 56 in which the package of roving is being wound and in which the package during winding is subjected to heat treatment. The wall or partition 54 is associated with the traverse mechanism, both the wall 54 and the traverse mechanism moving in a right-hand direction as viewed in FIG. 1 during winding of a package whereby the enclosure or chamber 56 is progressively enlarged as the package increases in size. As can be seen the wall or partition is mounted for automated movement.

Means is provided for supplying heat onto the package in the chamber 56 and maintaining an elevated temperature in the chamber. One or more radiant heaters may be employed, there being illustrated two radiant heaters 60 and 61 disposed in the chamber 56. The heaters are preferably of the electrically energized infrared type and are mounted upon brackets or support means 63. The brackets or radiant heater supports 63 are mounted on the relatively movable member or wall 54 so that as the package being formed increases in size and the wall is moved to accommodate the enlarging package, the radiant heaters 60 and 61 will be moved with the wall.

The radiant heaters 60 and 61 extend lengthwise of the package and in substantial parallelism with the axis of the mandrel 40. The heaters are preferably mounted to project radiant heat directly onto a lengthwise region of the package as near the package as possible.

Figure 4:
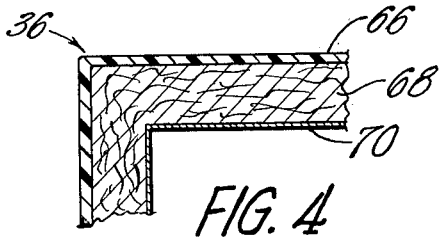
FIG. 4 is a fragmentary detailed sectional view illustrating a form of wall construction of the package winding chamber or enclosure.
Figure 3:
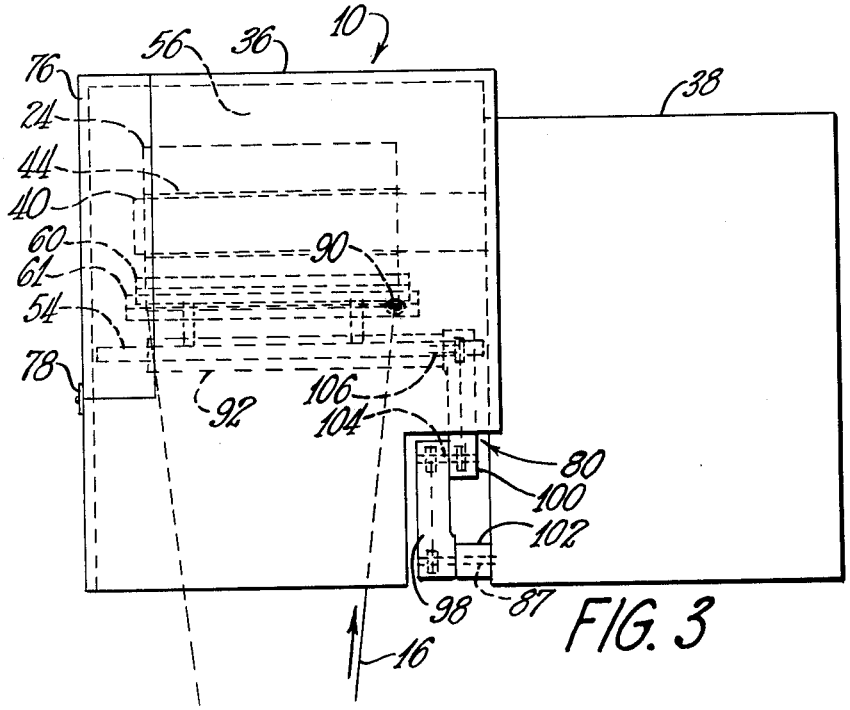
FIG. 3 is a top plan view of the winding apparatus shown in FIGS. 1 and 2.

The housing construction 36 is of highly insulated character in order to minimize heat loss from the chamber or enclosure 56. FIG. 4 illustrates in enlarged detail a corner of the housing construction 36. The exterior wall 66 of the housing 36 is preferably of fiber-reinforced resinous material but may be fashioned of metal if desired. The interior of the housing wall 66 is lined with insulation 68 of substantial thickness. The insulation material 68 is preferably of mineral fibers such as glass fibers but other suitable insulation may be used.

The interior surfaces of the insulating material of the housing construction are lined with material of heat-reflective character. The interior surface or lining 70 of the housing construction may be of sheet metal, metal foil or the like having high heat-reflective characteristics. Through the provision of the inner heat-reflecting surfaces provided by the metal lining 70 for the chamber 56, the radiant heat is re-reflected by the metal surfaces and hence the elevated temperature is more uniform throughout the chamber 56 and the temperature of the package of roving being wound thereby rendered more uniform for heat-treating the coating material on the strands of the roving 16.

The partition or relatively movable wall 54 is of a similar construction. The interior surface 73 of the movable wall 54 is of metal, metal foil or other material having heat-reflective characteristics. The core of the movable wall or member 54 is of insulating material such as the insulation 68 shown in FIG. 4 and the exterior surface material of the member or wall 54 may be of sheet metal or rigid sheet plastic.

The housing 36 is provided with an opening which is normally closed by a door or closure 76 pivotally mounted on the housing 36 by hinges 78. Through this means, access is provided for telescoping forming tubes 44 onto the mandrel 40 and for removing the completed packages 24 of roving. The door 76 is of the same insulated construction as the housing 36 as shown in detail in FIG. 4, the inner surfaces of the door construction being heat-reflective. The walls of the housing section 38 may be of sheet metal or plastic but do not require fibrous insulation.

The winding machine 10 embodies a traversing arrangement 80 for reciprocating the advancing bundle of strands or roving 16 in directions axially of the package 24 to distribute the bundle or roving lengthwise on the package. The traversing arrangement is of the character disclosed in the U.S. Pat. No. to Smith 3,717,311. The shaft 51 of the motor 48 is equipped with a second sheave 83 which drives a sheave 85 through a connecting belt 86. The sheave 85 drives a shaft 87. The speed of the output shaft 51 of the motor 48 determines the rotational speed of the collet or mandrel 40 and the speed of the traversing arrangement 80.

Components of the traversing arrangement 80 are mounted by a support 88 to which is secured the movable partition or chamber wall 54. When the traversing mechanism moves away from the package during a winding operation, the movable wall or partition 54 moves with the support 88. The traversing arrangement includes a traverse guide or guide eye 90 accommodating the roving 16 and means for reciprocating the traverse guide or guide eye 90 axially of the collet 40.

Mounted by the support 88 is a cam housing 92 in which is journally supported a cylindrical traversing cam 94 having a multiple return groove which groove accommodates a cam follower 96. Journally supported upon the housing 92 is an idler roll 93, the roving passing through a narrow slot in the partition 54 and over the idler roll 93 thence through the guide eye 90. The housing 92 has a lengthwise arranged slot for guiding the cam follower 96 and the guide eye 90 in a rectilinear path during their reciprocatory movements. Rotation of the cylindrical cam 94 moves the traverse guide 90 back and forth along the slot in the housing 92 in a direction parallel to the axis of rotation of the collet 40.

The driven shaft 87 rotates the cylindrical cam 94 through a drive system contained within hollow connectors or members 98 and 100. The shaft 87 is journally supported within a member 102 mounted by the housing portion 38. One end region of the connector 98 is pivoted for movement about the axis of the shaft 87. The opposite end of the connector 98 is pivotally connected with one end region of the connector 100 by a shaft 104. The other end region of the connector 100 is pivoted for movement about a shaft 106 which is journaled by the cam housing 92 and drives the cylindrical traverse cam 94.

Rotation of the shaft 87 is transmitted to the traverse cam driving shaft 106 by means of sheaves and connecting belts contained within the hollow connectors or members 98 and 100. The pivotal connection of the connectors about the axis of the shaft 104, the pivotal support of connector 98 provided by the shaft 87 and the pivotal connection of the connector 100 with the housing 92 about the axis of the shaft 106 provide a toggle arrangement whereby the cam housing 92, support 88 and partition or wall 54 are moved as a unit as the package increases in size while maintaining a drive arrangement for the traverse cam 94.

The relatively movable wall 54, support 88 and the housing 92 carrying the traverse mechanism are movable horizontally in a rectilinear path within the housing structure 36. The support 88 includes a base section 108 and an extending portion 110, parallel guide means including a stationary rod or shaft 112 and a stationary channel member 114 provide a mounting for the unit comprising the partition 54, support 88 and the traverse housing 92.

The shaft or rod is supported at its ends by brackets 116, shown in FIG. 1, carried by the housing construction. The rod or shaft extends through a bore in the support 88 which is adapted for slidable movement along the shaft 112. Guide means 120 on the base portion 108 slidably engage the channel 114. Through this arrangement the support 88 and its components are guided for horizontal slidable movement by the rod 112 and the channel member 114.

Journally mounted upon the traverse cam housing 92 is a rotatable member or component 122 usually referred to as a roller bail which is arranged for continuous contact with the lengthwise peripheral surface of the winding package 24 throughout the package build. Means is provided for establishing and maintaining pressure on the cylindrical member or roller bail 122 in engagement with the package yet permitting the roller bail 122, partition 54, support 88 and traverse housing 92 to move away from the package as the package increases in size.

The engagement of the roller bail 122 under pressure against the peripheral surface of the package being wound rotates the roller bail 122 which drives a generator (not shown) mounted on the housing 92 which, through a control arrangement as disclosed in the U.S. Pat. No. to Smith 3,717,311, reduces the speed of the motor 48 and consequently the speed of the collet and the traversing arrangement to maintain the peripheral surface speed of the package substantially constant.

The means for exerting pressure on the cylindrical member or roller bail 122 against the moving surface of the package 24 includes a fluid biasing means, such as an air motor 126, rotatably mounted disc guides 130 and 132 and cords or cables 133 and 134. The air motor 126 includes a cylinder 136 in which is reciprocably disposed a piston 138. One end of each of the cords 133 and 134 is connected to the piston 138 and the other end of each of the cords is secured to the support 88, the respective cords passing over the discs 130 and 132 as shown in broken lines in FIG. 1.

Compressed air under uniform pressure is admitted into the cylinder 136 at the left-hand side of the piston 138 as viewed in FIG. 1. The pressure against the piston exerts a force on the cord or cable 133 urging the support 88 in a left-hand direction as viewed in FIG. 1 to bias the roller bail 122 into constant engagement with the surface of the package 24 being formed.

The air motor includes an air release engagement (not shown) for providing constant pressure resisting movement of the piston 138 so that the roller bail or cylindrical member 122 is in continuous uniform pressure contact with the surface of the package 24 during the period that the winder builds the package 24. When the winding package 24 is completed, the air control arrangement moves the support 88 away from the completed package.

Figure 2:
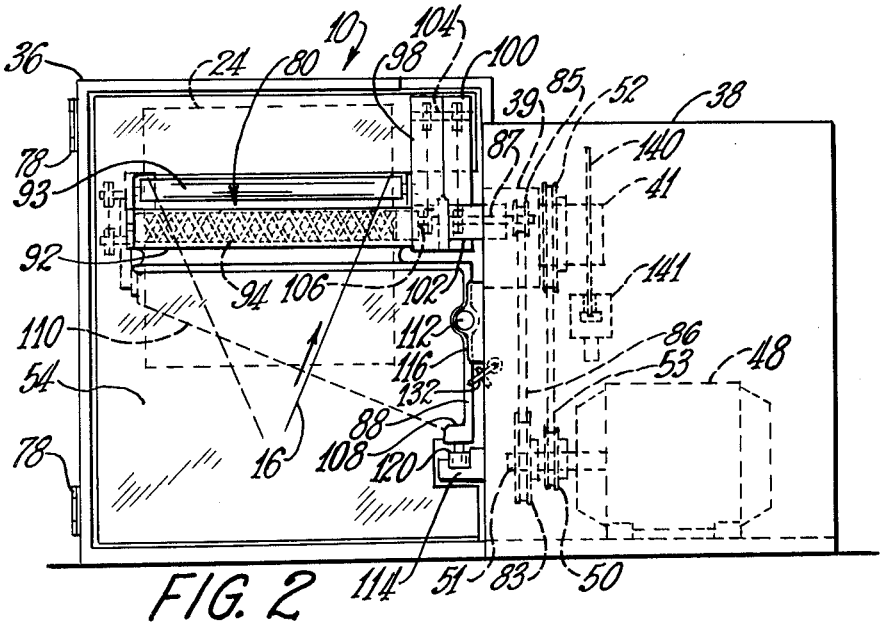
FIG. 2 is a rear elevational view of the winding apparatus illustrated in FIG. 1.

Braking means is provided for stopping rotation of the package at the completion of a winding operation. As shown in FIG. 2, the drive shaft 41 is equipped with a brake disc 140 in association with a solenoid-operated braking means 141. The braking means 141 is energized by conventional means (not shown) to engage the disc when the package is completed to stop rotation of the package.

Numerous advantages are attained through the use of the method of winding or forming a package of roving in an enclosed environment or chamber in which radiant heat is directed onto the surface of the package and heat energy rereflected by the reflective surfaces of the enclosure or chamber. The enclosed winding environment or chamber is maintained at an elevated temperature which is substantially uniform throughout the chamber.

The radiant heat applied to the package during its formation is sufficient to soften the coating or sizing on the strands to integrate or cohere the strands of the bundle or roving in a ribbonized body. This method or process facilitates more efficient and effective heat treatment or softening of the coating material or sizing on the strands of the roving whereby the coating material or sizing will cohere or adhere the strands so that upon cooling of the package a ribbonized, unitized or united roving can be readily removed or withdrawn from the package.

As a typical example of operating conditions, the temperature at the surface region of the package receiving direct radiant energy from the heaters may be from about 250° F. to 400° F. The temperature of the enclosure or chamber 56 by reason of the insulated walls and heat-reflective characteristics of the inner lining of the walls is maintained at about 180° F. to 200° F. Substantial savings in heat energy are effected for treatment of the coating on the strands as the package is being formed through the use of the enclosed winding chamber or oven.

As an example, heretofore in effecting a softening or treatment of the sizing or coating on the strand in winding a package in an open environment using radiant heaters, the expenditure of electric energy is about 5900 watts. Utilizing the method of the invention described herein for heat-treating a package of the same size during its formation in the enclosure or chamber 56, the amount of energy expended for softening or treating the material on the strands of the roving is about 2400 watts.

Thus the invention not only provides for substantial conservation of heat energy, but there is attained a more uniform softening or heat treatment of the coating on the strands throughout the package. The package of roving does not require any further heat treatment in a separate oven.

In the operation of the winding apparatus, the operator opens the door 76 and telescopes an empty forming tube or collector 44 onto the collet or mandrel 40. The operator then manually winds a few turns of the roving 16 onto the forming tube 44 and closes the door 76 to confine the heat energy in the winding enclosure or chamber 56. The operator closes a switch (not shown), initiating the control circuits for the motor 48, the radiant heaters 60 and 61 and the controls for the air motor 126.

The radiant heaters 60 and 61 are energized and operation of the air motor 126 concomitantly initiated. Through the air control means, compressed air is admitted into the cylinder 136 of the air motor 126 at the left-hand side of the piston 138 to move the partition 54, support 88 and the roller bail 122 in a left-hand direction, as viewed in FIG. 2, to engage the roller bail with the turns of roving on the forming tube 44 supported on the collet 40.

By means of a conventional time delay relay, the motor 48, within a short period of time, is energized to initiate rotation of the mandrel 40 so that power winding of a package is begun on the forming tube 44. The radiant heaters 60 and 61 direct heat onto the bundle of strands or roving as it is wound on the forming tube 44.

The relatively movable wall or partition 54 at the start of winding of a package is at its extreme left-hand position with reference to FIG. 1, in which position the chamber 56 is of its smallest volume or size. As the package 24 progressively increases in size, the package 24, being in engagement with the roller bail 122, moves the roller bail 122, movable wall or partition 54 and support 88 in a right-hand direction as viewed in FIG. 1 whereby the chamber 56 is increased in size to accommodate the enlarging package.

As the roller bail 122 is rotated by its pressure engagement with the package, it drives the generator (not shown) mounted by the housing 92, the generator providing an input for an electrical control that regulates the electrical power to the variable speed motor 48 to progressively reduce the rotation of the collet 40 to keep the surface of the package 24 at a constant speed whereby the linear speed of the advancing roving or bundle of strands 16 is essentially constant.

As the speed of the traversing arrangement reduces proportionately with the rotational speed of the collet 40, the winder maintains a uniform disposition of the bundle or roving throughout the layers of the bundle or roving of the package 24.

At the completion of winding of a package in the chamber 56, a timer associated with the circuit of the motor 48 times out de-energizing the motor, energizes the brake 141 to stop rotation of the package and de-energizes radiant heaters 60 and 61. The air control for the air motor 126 transfers air pressure to the right-hand side of the piston 138 as viewed in FIG. 1 to move the roller bail 122 away from engagement with the completed package.

The door 76 is opened, the roving 16 severed by the operator whereby the package may then be removed from the collet 40 preparatory to winding a succeeding package on thw winding apparatus. It is found that upon cooling of the package the coating material or sizing coheres the strands providing a ribbonized, unitized or united roving that can be readily removed or withdrawn from the package for further processing.

It is apparent that, within the scope of the invention, modifications and different arrangements may be made other than as herein disclosed, and the present disclosure is illustrative merely, the invention comprehending all variations thereof.

I claim:

1. The method of producing a wound strand package comprising advancing the strand into an enclosure, winding the strand into a package within the enclosure, enlarging the enclosure as the package increases in size, and heating the package in the enclosure during winding of the package.

2. The method according to claim 1 including heating the package within the enclosure by radiant heat.

3. The method of producing a package of roving from a plurality of substantially dry glass strands withdrawn from strand packages wherein the strands are coated with a heat-treatable material including the steps of advancing the strands from the strand packages, gathering the strands into a linear bundle, advancing the bundle into a substantially closed chamber, winding the bundle into a package within the chamber, enlarging the chamber as the package increases in size, and heating the interior of the chamber during winding of the package to cause the coating to cohere the strands of the bundle together to form a united strand roving.

4. The method according to claim 3 including engaging the bundle prior to winding of the bundle with surfaces orienting the bundle into ribbon-like configuration.

5. The method according to claim 3 including heating the interior of the chamber by radiant heat.

6. The method according to claim 5 including modifying the position of the source of radiant heat as the package increases in size.

7. The method of producing a package of roving from a plurality of substantially dry glass strands withdrawn from strand packages mounted on a creel wherein the strands are coated with a material capable of cohering the strands together including advancing the glass strands from the strand packages, combining the individual strands into a linear bundle, advancing the bundle into an enclosure, winding the bundle into a package within the enclosure, radiantly heating the interior of the enclosure, enlarging the enclosure as the package increases in size, and reflecting heat by the interior surfaces of the enclosure to establish a temperature within the enclosure effective to cause the coating to cohere the strands of the bundle together so that upon cooling of the package a united strand bundle can be removed therefrom.

8. Apparatus for producing a wound strand package comprising an enclosure, rotatable means for winding the strand into a package within the enclosure, a relatively movable wall of the enclosure mounted for automated movement to enlarge the enclosure as the package increases in size, and means for heating the package within the enclosure at it is being wound.

9. The apparatus according to claim 8 wherein a portion of the interior surface area of the enclosure is lined with a heat-reflecting material.

10. Apparatus according to claim 8 wherein the heating means comprises a radiant heater disposed within the enclosure.

11. The apparatus according to claim 10 wherein the radiant heater is movable within the enclosure.

12. Apparatus for producing a roving package comprising means for supplying glass strands bearing a coating material capable of cohering the strands together, means for combining the glass strands into a linear bundle, means providing a walled chamber, rotatable mandrel means within the chamber for winding the bundle of strands into a package, radiant heating means for heating the package within the chamber as the package is being wound, a relatively movable wall of said chamber mounted for automated movement to enlarge the chamber as the package increases in size, the radiant heat within the chamber being sufficient to cause the coating to cohere the strands of the bundle together.

13. The apparatus according to claim 12 including means for mounting the radiant heating means on the movable wall.

14. The apparatus according to claim 12 including traverse means mounted by the movable wall for traversing the bundle of strands lengthwise of the package.

15. The apparatus according to claim 12 including means responsive to the enlarging package for effecting relative movement of the movable wall.

* * * * *

UNITED STATES PATENT AND TRADEMARK OFFICE

CERTIFICATE OF CORRECTION

PATENT NO. : 4,214,931

DATED : July 29, 1980

INVENTOR(S) : Stanley P. Wojciechowski

It is certified that error appears in the above—identified patent and that said Letters Patent is hereby corrected as shown below:

Column 6, line 28, "engagement" should read -- arrangement --.

Column 6, line 49, "rereflected" should read -- re-reflected --.

Column 8, line 18, "thw" should read -- the --.

Column 9, line 12, "at" should be -- as --.

Signed and Sealed this

*Twenty-eighth* Day of *October 1980*

[SEAL]

*Attest:*

SIDNEY A. DIAMOND

*Attesting Officer*

*Commissioner of Patents and Trademarks*